US007254960B2

(12) United States Patent
Schmid et al.

(10) Patent No.: US 7,254,960 B2
(45) Date of Patent: Aug. 14, 2007

(54) AIR DUCT ARRANGEMENT FOR A REFRIGERATOR

(75) Inventors: Alexandre Cury Schmid, Joinville-Sc (BR); Claiton Emilio Do Amaral, Joinville-SC (BR); Ignacio Joao Dos Santos Junior, Joinville-SC (BR); Adriano Cargnin, Joinville-Sc (BR); Rogerio Rodrigues Junior, Joinville-SC (BR); Edson Luiz Izui, Joinville-SC (BR); Marco Eduardo Marques, Joinville-SC (BR)

(73) Assignee: Multibras S.A. Eletrodomesticos, Sao Paulo-SP (BR)

( * ) Notice: Subject to any disclaimer, the term of this patent is extended or adjusted under 35 U.S.C. 154(b) by 368 days.

(21) Appl. No.: 10/504,922

(22) PCT Filed: Feb. 18, 2003

(86) PCT No.: PCT/BR03/00022

§ 371 (c)(1),
(2), (4) Date: Aug. 17, 2004

(87) PCT Pub. No.: WO03/071204

PCT Pub. Date: Aug. 28, 2003

(65) Prior Publication Data

US 2005/0126205 A1 Jun. 16, 2005

(30) Foreign Application Priority Data

Feb. 22, 2002 (BR) ..... 0200593
Dec. 20, 2002 (BR) ..... 0205557

(51) Int. Cl.
*F25D 17/04* (2006.01)

(52) U.S. Cl. ..... 62/407; 62/440

(58) Field of Classification Search ..... 62/407, 62/408, 440

See application file for complete search history.

(56) References Cited

U.S. PATENT DOCUMENTS

| | | | | |
|---|---|---|---|---|
| 2,532,816 | A | 12/1950 | Kurtz | |
| 3,096,628 | A | 7/1963 | Beckett et al. | |
| 3,169,383 | A | 2/1965 | Morton et al. | |
| 4,671,074 | A | 6/1987 | Gostelow et al. | |
| 6,539,729 | B2 * | 4/2003 | Tupis et al. | 62/89 |
| 6,675,604 | B2 * | 1/2004 | Lee et al. | 62/407 |

* cited by examiner

*Primary Examiner*—Melvin Jones
(74) *Attorney, Agent, or Firm*—Darby & Darby

(57) ABSTRACT

An air duct arrangement for a refrigerator with forced air circulation of the type that comprises a refrigerating compartment (20) provided with a diffusing duct (23) receiving a refrigerated forced airflow from an air cooling compartment (40). The arrangement comprises at least one distributing duct (60) disposed in the upper portion of a space (V) defined below at least one of the shelves (22). The distributing duct (60) presents a rear end (61) opened to the inside of the diffusing duct (23) and a front end (62) opened to the front region of said space (V) adjacent to the front door (21) of the refrigerating compartment (20) and provided with a plurality of front openings (64, 65, 66) turned to the front region of said space.

20 Claims, 13 Drawing Sheets

AIR DUCT ARRANGEMENT FOR A REFRIGERATOR

FIELD OF THE INVENTION

The present invention refers to a duct arrangement for the circulation of air in refrigerators with forced air circulation presenting a single cabinet, inside which is defined a refrigerating compartment and, optionally, a freezing compartment, which is usually separated from the refrigerating compartment by an intermediate wall. The invention is specifically directed to a duct arrangement to make uniform the circulation of air inside the refrigerating compartment and to intensify the supply of air to determined regions of said compartment.

BACKGROUND OF THE INVENTION

The refrigerators with forced air circulation are usually provided with an air supply duct disposed on the rear wall of the refrigerating compartment and provided with air outlet front openings, which are turned to the spaces defined between the shelves of the refrigerating compartment.

A known usual construction of a refrigerator with forced air circulation is illustrated in FIGS. 1–2 of the enclosed drawings. In this construction, the refrigerator is of the combined type, comprising a freezing compartment 10 and a refrigerating compartment 20, which are superposed, provided with respective front doors 11 and 21, and separated by an intermediate wall 30.

Inside the refrigerating compartment 20 there are provided shelves 22 generally in a single piece and made of plastic or glass, between which is supplied the refrigerated air coming from front openings 23*a* provided in a diffusing duct 23, which is generally affixed internally to the central region of the rear wall of the refrigerating compartment and has an end, for example the upper end, receiving a refrigerated forced airflow coming from an air cooling compartment 40 lodging an evaporator 45 and a fan 46 and which, in the combined refrigerators, is usually disposed close to the rear region of the freezing compartment 10.

It should be understood herein that the diffusing duct 23 may be provided in the refrigerating compartment 20 of a simple refrigerator (not combined) in which the air cooling compartment 40 is positioned close to the rear upper region of the refrigerating compartment 20. Regardless of the fact of the refrigerator being combined, the return of the circulated air to the air cooling compartment is made by collecting said circulated air in the front or rear region of the refrigerating compartment 20.

With the prior art construction described above, the refrigerated air coming from the air cooling compartment 40 is supplied to the diffusing duct 23 of the refrigerating compartment 20, and then supplied to the latter through front openings 23*a* of the diffusing duct 23. The refrigerated air is thus supplied to the gaps or spaces V between the shelves 22, according to substantially horizontal paths extended in the central region of the refrigerating compartment 20 toward the front door 21, where said refrigerated air is converted in an ascending vertical flow developing between the door 21 and the front edge of the shelves 22 and which is collected, for example in the front upper region of the refrigerating compartment 20 and conducted to the air cooling compartment 40 by one or more return ducts 50 provided inside the intermediate wall 30 or in any other adequate part of the structure of the refrigerator, as illustrated by the arrows S.

The prior art forced air circulation system described above presents the disadvantage of producing a not completely uniform distribution of the refrigerated air to the different regions of the refrigerating compartment 20, due to the fact that the supply of refrigerated air is effected only in the central region of said compartment and from the rear wall thereof.

Another negative aspect of the known solutions results from the poor refrigeration to which the internal region of the front door 21 is submitted, since in this region is formed the ascending flow of the warmer circulated air that is returned to the air cooling compartment 40.

Another disadvantage of the known arrangements is due to the fact that the distribution of the refrigerated air inside the refrigerating compartment is fixed, allowing no alterations in the distribution of the refrigerated air to the different regions to be refrigerated.

OBJECTS OF THE INVENTION

By reason of the disadvantages mentioned above, it is an object of the present invention to provide an air duct arrangement for a refrigerator of the type with forced air circulation and comprising a refrigerating compartment, which is capable of providing a uniform distribution of the refrigerated forced airflow to different regions of said compartment.

It is a further object of the present invention to provide an air duct arrangement such as mentioned above, which allows to selectively intensify the supply of the refrigerated air to different regions of the refrigerating compartment, there included the region that is adjacent to the internal face of the front door.

SUMMARY OF THE INVENTION

In order to comply with the objects of the invention, the air duct arrangement of the present invention is applied to a refrigerator of the type which comprises a refrigerating compartment closed by a door and lodging a plurality of shelves, and a diffusing duct mounted close to a rear wall of the refrigerating compartment, in order to receive a refrigerated forced airflow from an air cooling compartment.

According to the invention, the arrangement comprises at least one distributing duct disposed in the upper portion of the space defined below at least one of the shelves, said distributing duct having a rear end opened to the inside of the diffusing duct; a front end disposed in the front region of said space adjacent to the front door and provided with a plurality of front openings turned to the front region of said space, in whose upper portion is positioned the distributing duct.

The new construction proposed by the invention allows the refrigerated forced airflow coming from the air cooling compartment and supplied to the diffusing duct to be uniformly distributed along one or more spaces defined below the shelves, and to be also supplied to the region of the internal face of the door, which becomes adequately refrigerated. A flow control device, to be described ahead in the present specification, is optionally provided in the duct arrangement, in order to allow the user to select the region to have its refrigeration intensified.

BRIEF DESCRIPTION OF THE DRAWINGS

The invention will be described now, with reference to the enclosed drawings, given by way of example of possible embodiments of the invention, and in which.

DESCRIPTION OF THE ILLUSTRATED EMBODIMENT

Figure 1:
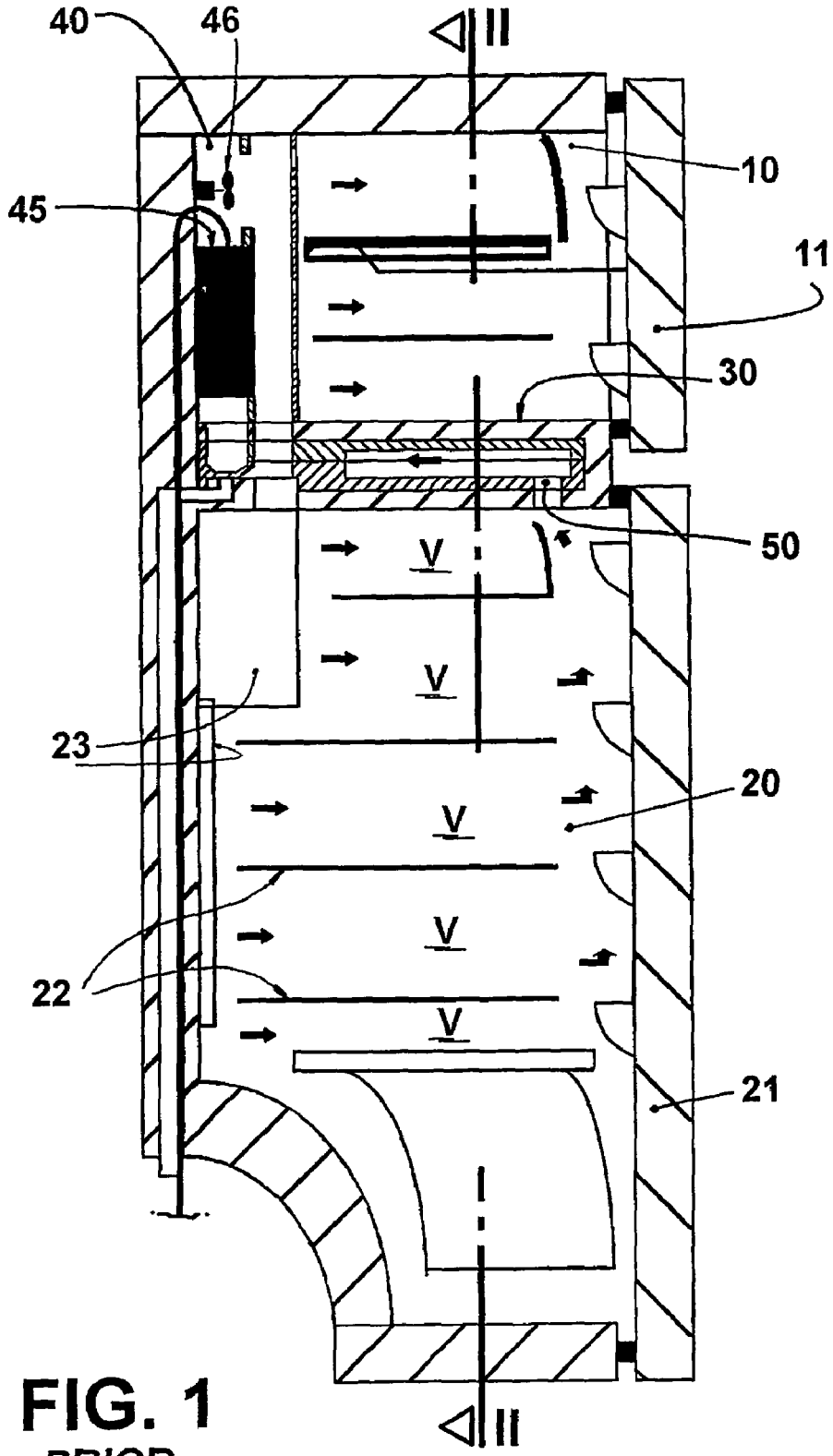
FIG. 1 PRIOR ART
FIG. 1 is a schematic vertical cross-sectional view of a possible construction for a combined refrigerator with forced air circulation utilized in the present invention, said view being taken to illustrate the return of air from the refrigerating compartment toward the air cooling compartment, according to the prior art.
Figure 2:
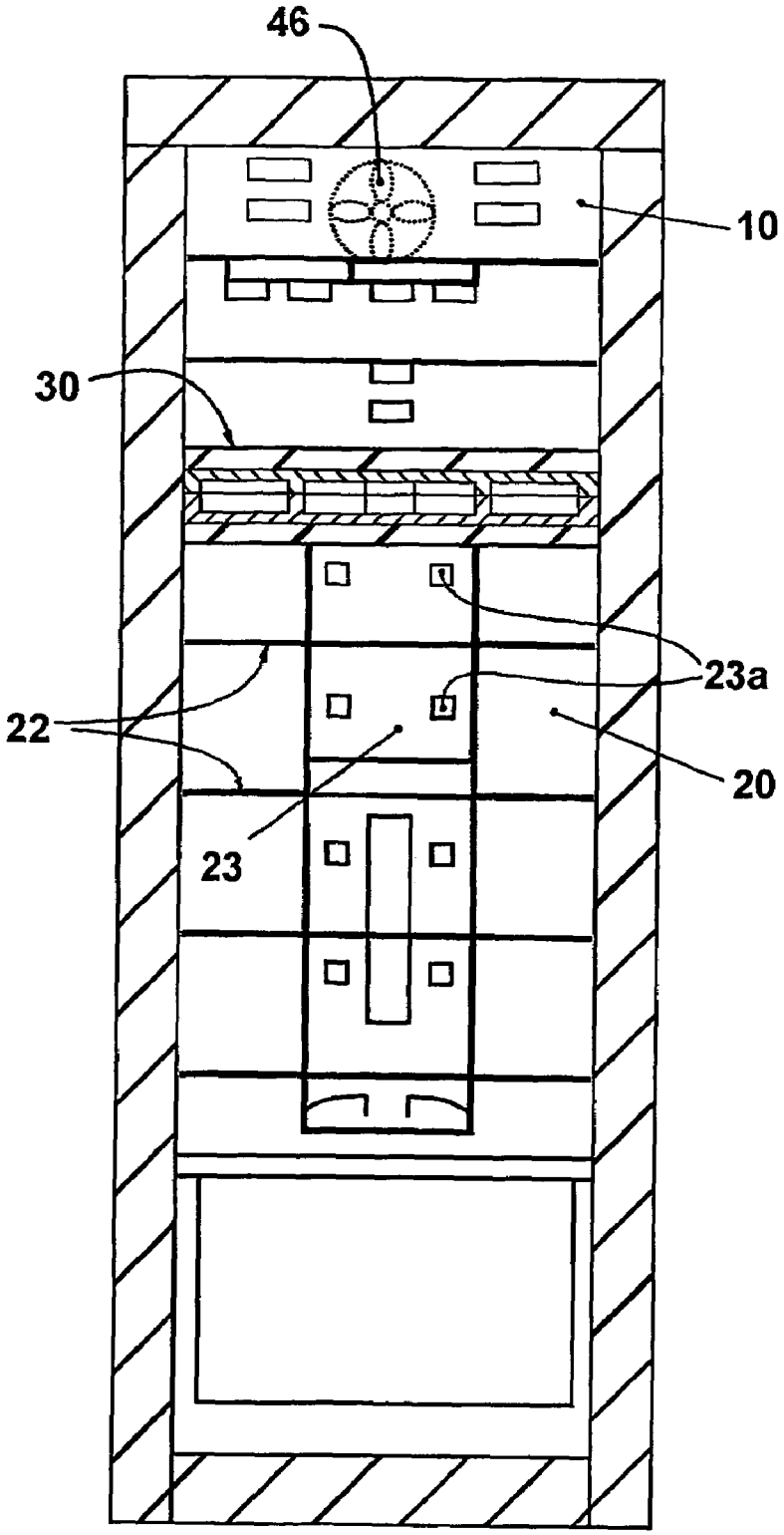
FIG. 2 PRIOR ART
FIG. 2 is a sectional view taken according to line II—II of FIG. 1, for a better visualization of the points in which the refrigerated forced airflow is supplied to the inside of the freezing and refrigerating compartments.
Figure 3:
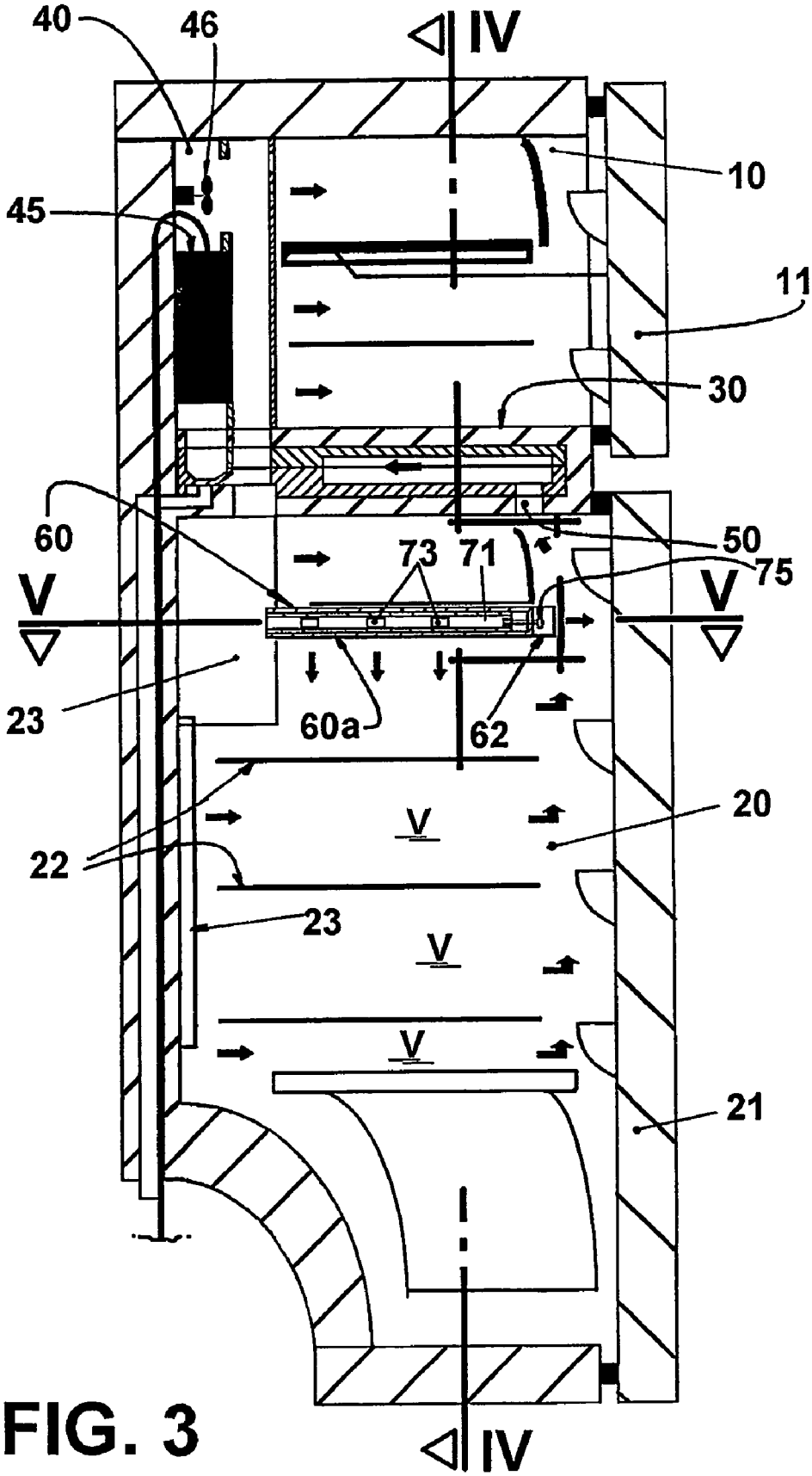
FIG. 3 is a similar view to that of FIG. 1, but illustrating the supply of refrigerated forced airflow toward the refrigerating compartment by the duct arrangement of the present invention.
Figure 4:
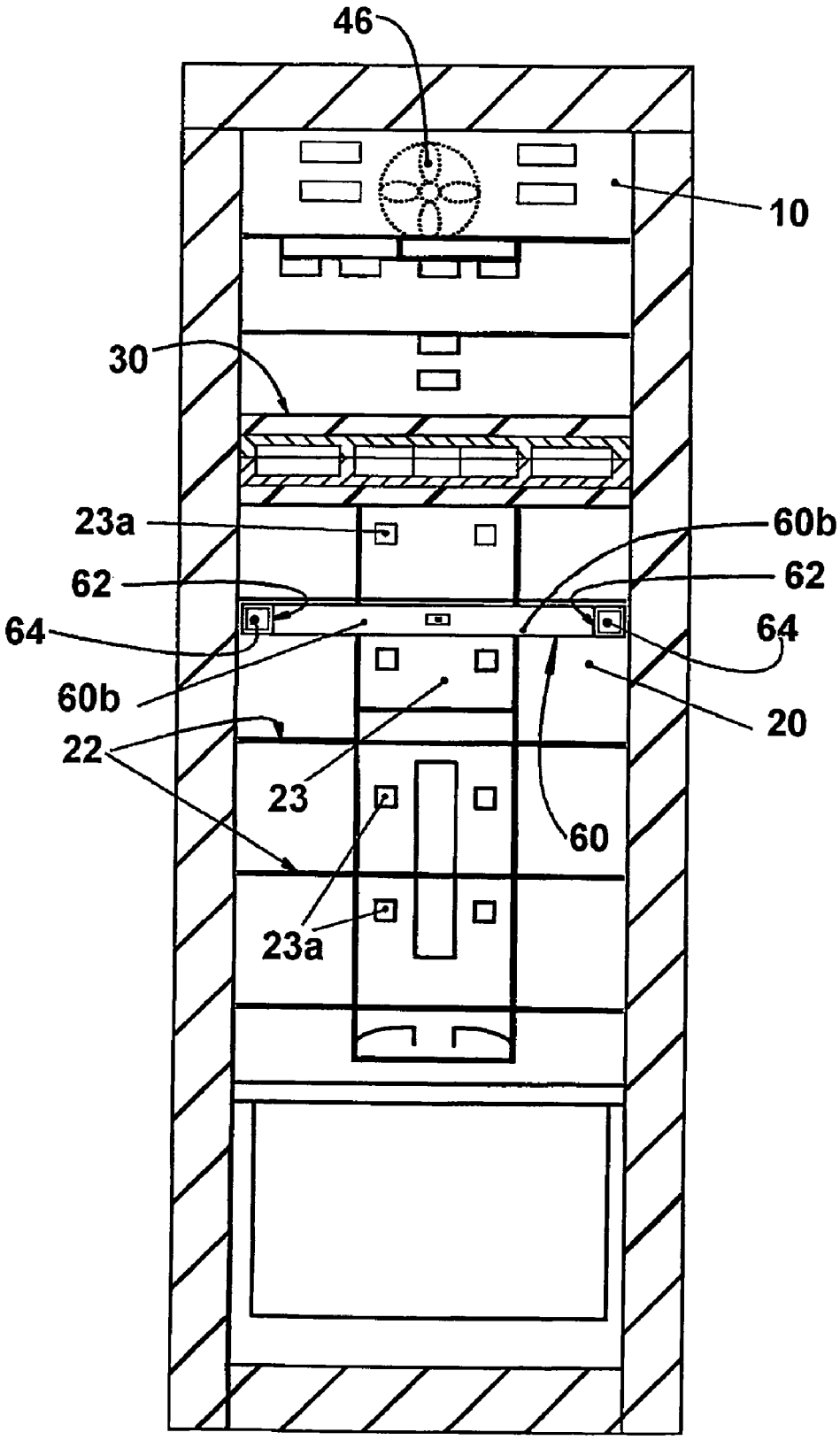
FIG. 4 is a sectional view taken according to line IV—IV of FIG. 3, illustrating the provision of the duct arrangement of the invention in a free space defined below one of the shelves of the refrigerating compartment.

As already mentioned above in the introduction of the present specification, the duct arrangement of the invention is applied to a refrigerator of the type described in relation to FIGS. 1 and 2. FIGS. 3, 4, 8, and 9 illustrate the same combined refrigerator given only by way of example and whose known component parts are designated with the same reference numbers used in FIGS. 1 and 2.

The refrigerator, to which the present duct arrangement is applied, need not be of the combined type, provided that it comprises a refrigerating compartment 20 presenting, close to a rear wall, a diffusing duct 23 generally centrally mounted and receiving, by an end, which in the illustrated example is the upper end, a refrigerated forced airflow coming from an air cooling compartment 40 (not illustrated for this constructive variation) that is adequately mounted to the structure of the refrigerator.

According to the invention, the duct arrangement comprises at least one distributing duct 60 disposed in the upper portion of the space V defined below at least one of the shelves 22 of the refrigerating compartment 20.

In the illustrated construction, the refrigerating compartment 20 is superiorly provided with a space V defined above the upper shelf 22 and forming an enhanced refrigeration chamber with a front little door. In this illustrated construction, the space V defined below said upper shelf 22 disposed immediately below the enhanced refrigeration chamber is provided with a distributing duct 60, having a rear end 61 opened to the inside of the diffusing duct 23, and a front end 62 opened to the region of the respective space adjacent to the front door 21.

It should be understood that each space V defined below a respective shelf 22 may be provided with one or more distributing ducts 60.

In the illustrated construction, there is provided only one distributing duct 60 presenting a rectilinear longitudinal duct extension 60*a* disposed along the central upper portion of a space V, said longitudinal duct extension 60*a* being preferably affixed below the shelf 22 disposed immediately above and delimiting superiorly the free space V in which the distributing duct 60 is installed. The longitudinal duct extension 60*a* is provided with a plurality of radial openings 63 turned to the inside of the space V in whose upper portion is positioned the distributing duct 60. In this exemplary construction, the longitudinal duct extension 60*a* of the distributing duct 60 incorporates, frontally, two transversal duct extensions 60*b* disposed mutually aligned along at least a substantial extension of the width of the refrigerating compartment 20 and which are also affixed to the same shelf 22, so as to have their internal ends connected to the longitudinal duct extension 60*a* and their external ends curved forwardly and defining a pair of front openings 64 of the distributing duct 60 which are turned forwardly and toward the region of the respective space V adjacent to the front door 21, on the sides of the refrigerating compartment 20, i.e., supplying the refrigerated air in front lateral regions of the refrigerating compartment 20 that are distant from the front central region of the latter, through which the circulated air to be returned to the air cooling compartment 40 flows upwardly.

Figure 5:
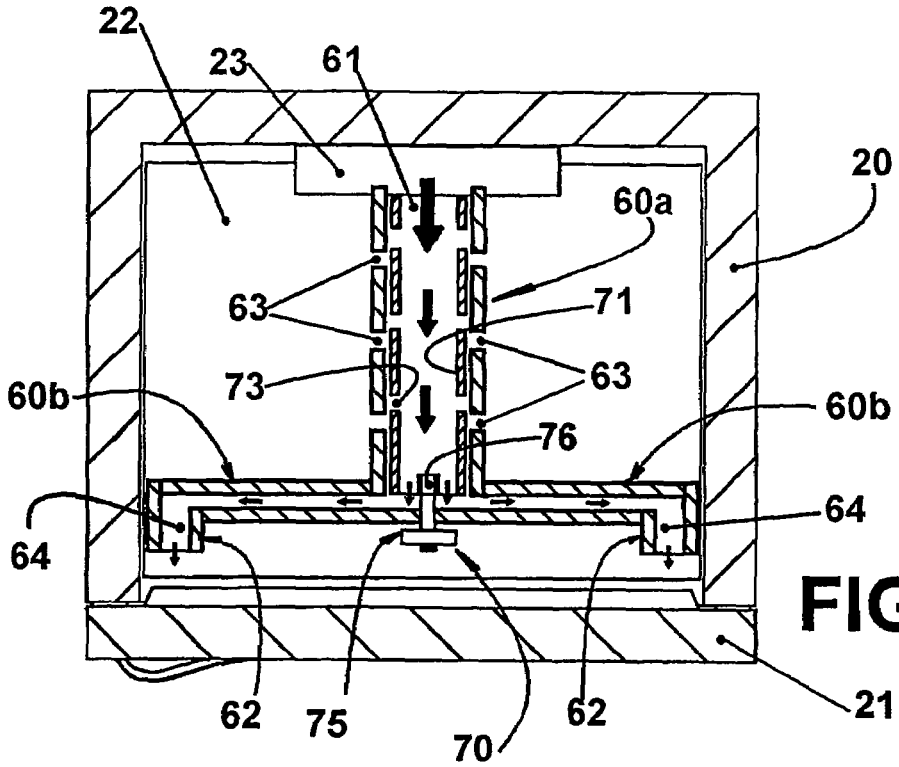
FIG. 5 is a sectional view taken according to line V—V in FIG. 3 of an embodiment for the duct arrangement of the invention when applied to a free space defined below a shelf of the refrigerating compartment and when adjusted to operate for intensifying the refrigeration in the internal region of the door.
Figure 6:
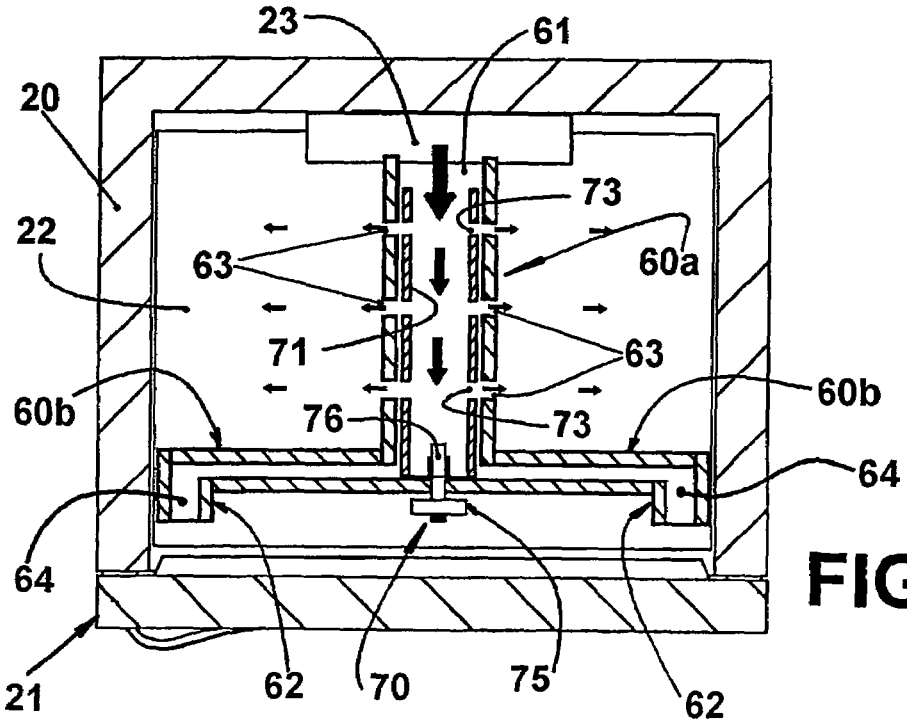
FIG. 6 is a similar view to that of FIG. 5, but illustrating the duct arrangement adjusted to make uniform the refrigeration along the whole depth of the free space of the refrigerating compartment in which it is provided.

As illustrated in FIGS. 5 and 6, the distributing duct 60 is preferably provided with a flow control device 70 which is operated by the user, allowing him to adjust the refrigerated forced airflow that is released from the radial openings 63 and from the front end 62, in order to select the region of the respective space V that will receive an increased flow of refrigerated forced air, and consequently an intensified refrigeration.

In the embodiment illustrated in FIGS. 3–7, the flow control device 70 comprises a tubular sleeve 71 which is tightly and slidingly mounted to the inside of the longitudinal duct extension 60*a* and provided with radial windows 73, which are aligned with the radial openings 63 of the former when the tubular sleeve 71 is axially forwardly displaced toward an advanced position, illustrated in FIG. 6, in which its front portion blocks the internal ends of both transversal duct extensions 60*b*, making the refrigerated forced airflow coming from the diffusing duct 23 to be expelled through the radial windows 73 and through the radial openings 63 to the inside of the respective space V, making uniform the refrigeration of the latter.

When the tubular sleeve 71 is axially rearwardly displaced toward the retracted position illustrated in FIG. 5, the radial openings 63 are closed by the lateral wall of the tubular sleeve 71 and the internal ends of the transversal duct extensions 60*b* are opened, allowing the refrigerated forced airflow to be directed to the front lateral regions of said space V, close to the front door 21, more intensively refrigerating the internal shelves thereof that are subject to said refrigerated forced airflow.

It is also possible to place the tubular sleeve 71 in intermediate positions, in order to obtain a desired balance between the refrigerated forced airflows supplied along the depth of the space V and to the opposite front lateral regions thereof.

The axial movement of the tubular sleeve 71 between its limit operational positions may be obtained, for example through a button 75 provided in the joining region of the two transversal duct extensions 60*b* and carrying a shaft 76, which is rotatively or axially affixed to the distributing duct 60 and presents an internal portion that is coupled to the tubular sleeve 71 to cause the displacement of the latter, as it is rotatively or slidingly actuated, for example in an axial direction, depending on the selected coupling system.

The positioning of the radial openings 63 along the longitudinal duct extension 60*a* can follow different patterns, such as for example the one that allows the supply of transversal horizontal and/or downward forced airflows.

Figure 7:
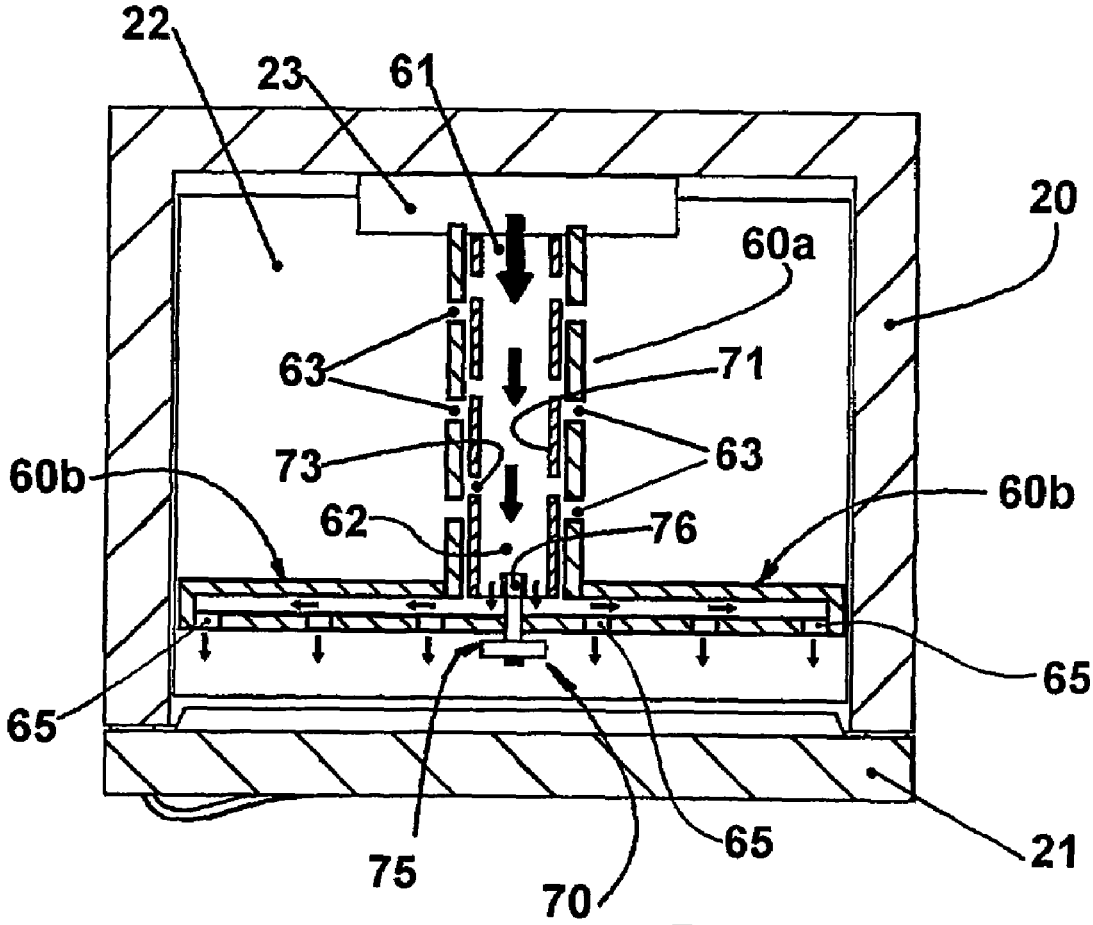
FIG. 7 is a similar view to that of FIG. 5, but illustrating a constructive variation for the duct arrangement, according to which multiple air outlet openings are provided in the internal region of the door.
Figure 8:
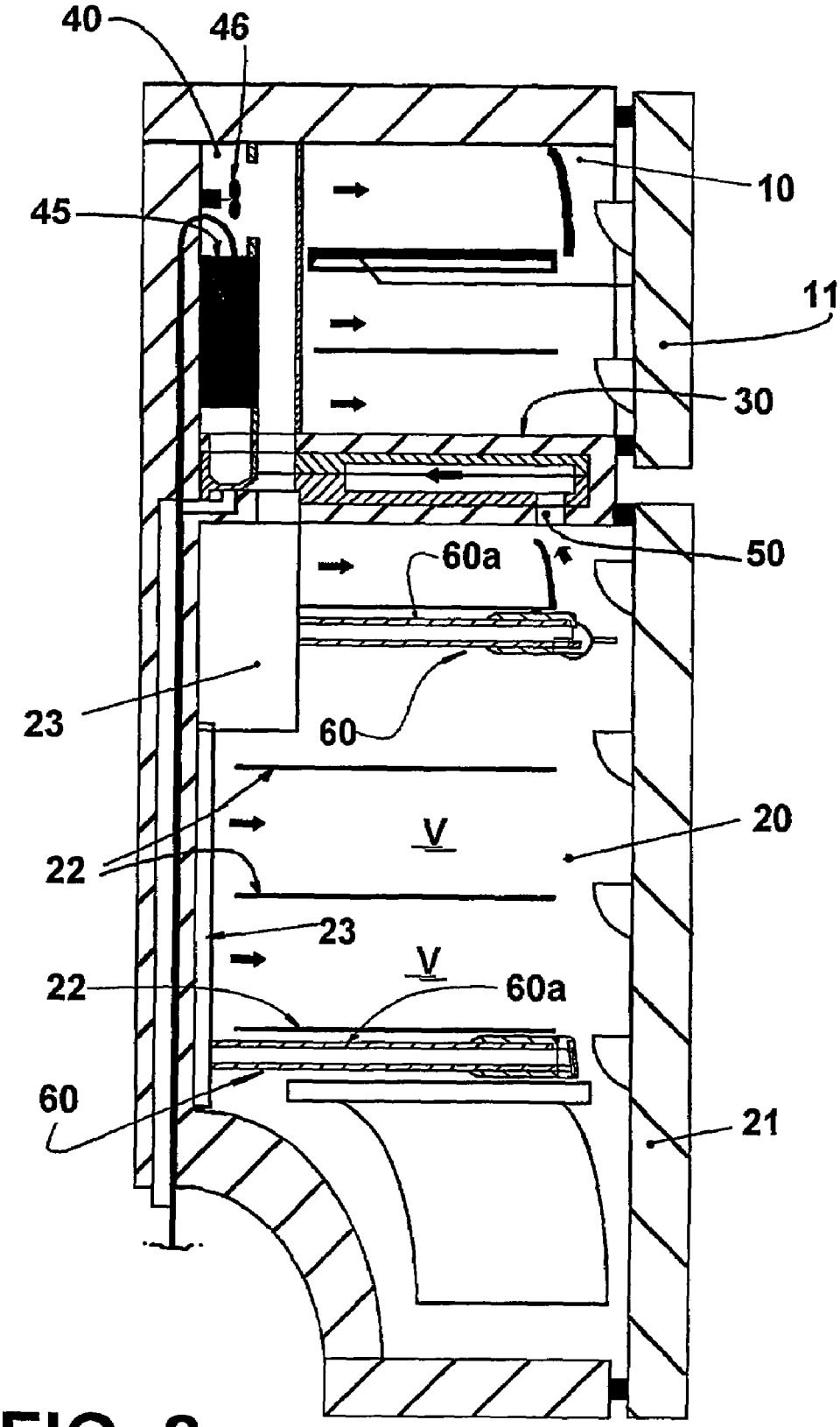
FIGS. 8, 9 and 10 are views respectively similar to those of FIGS. 3, 4, and 7, but illustrating another embodiment for the air duct arrangement of the present invention.
Figure 9:
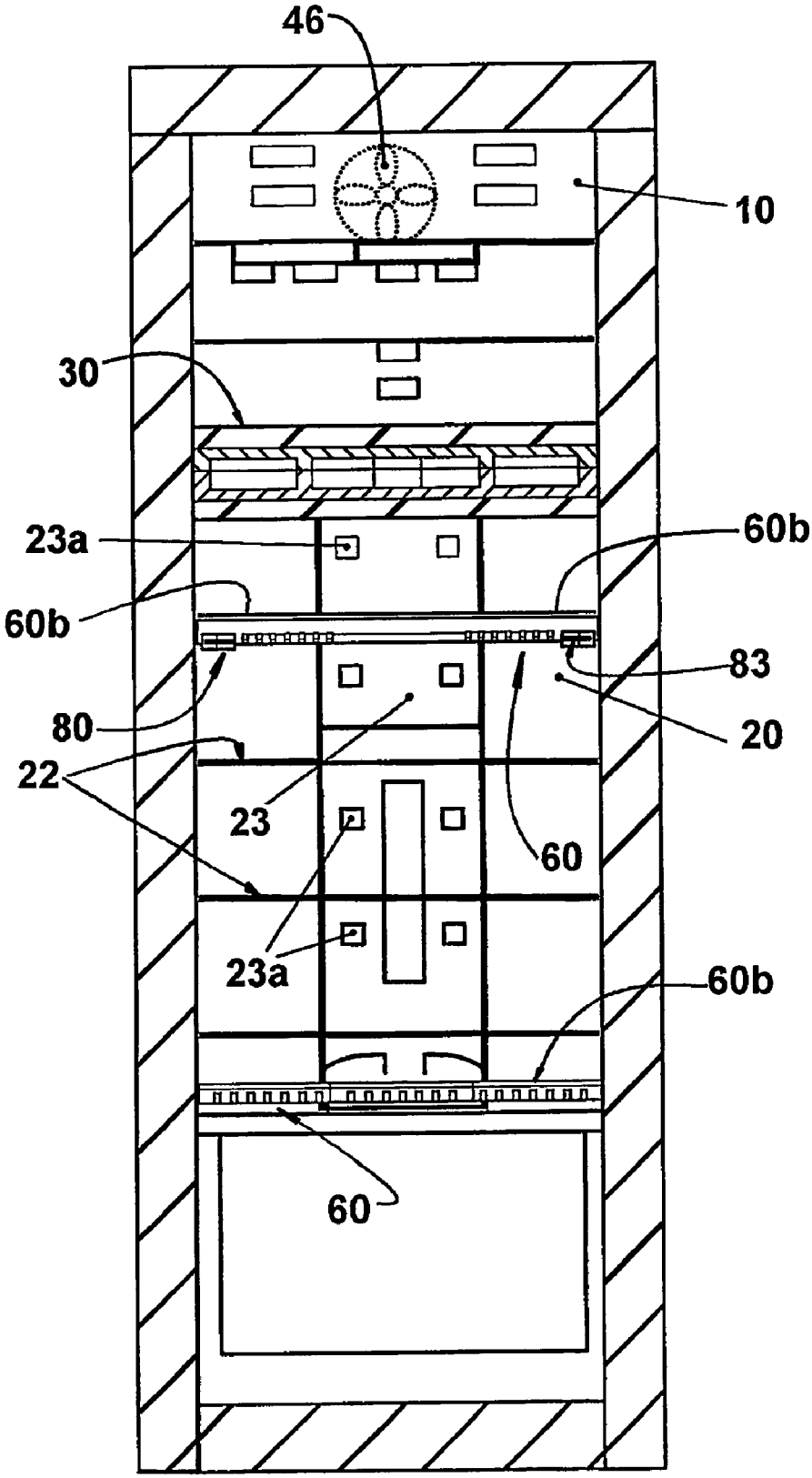
Figure 10:
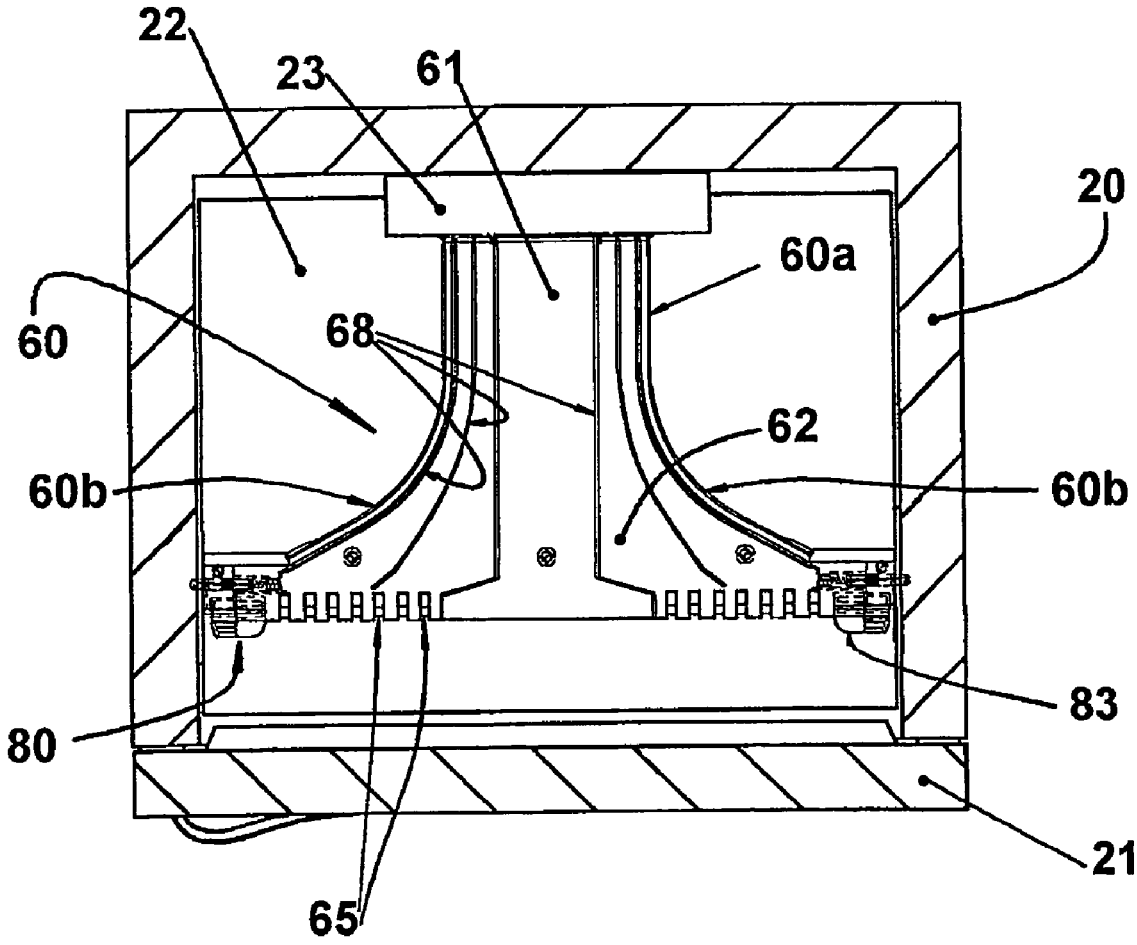
Figure 11:
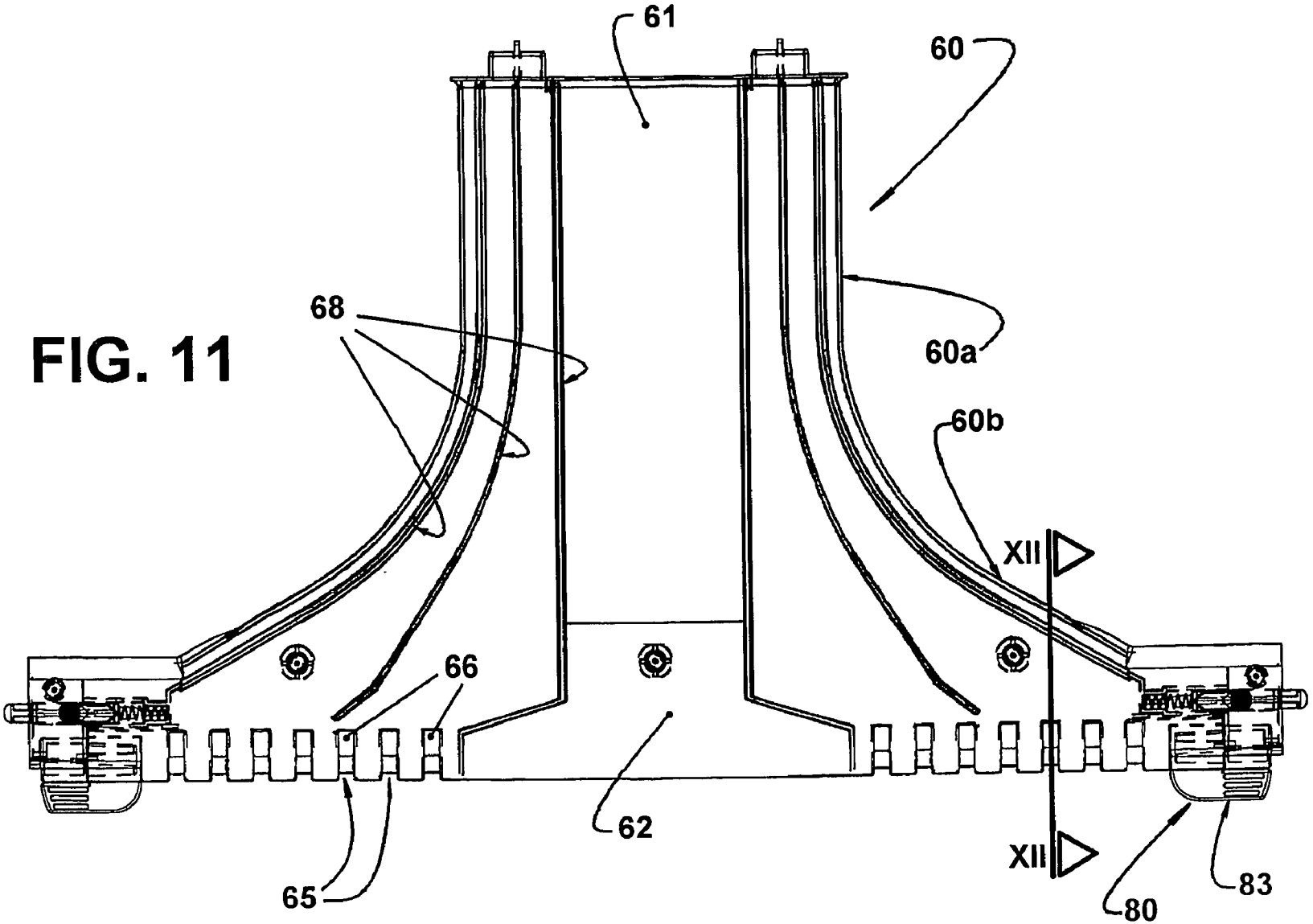
FIG. 11 is a top plan view of the distributing duct of FIGS. 8, 9 and 10 without its upper wall, for visualization of an arrangement of air directioning internal walls.
Figure 12:
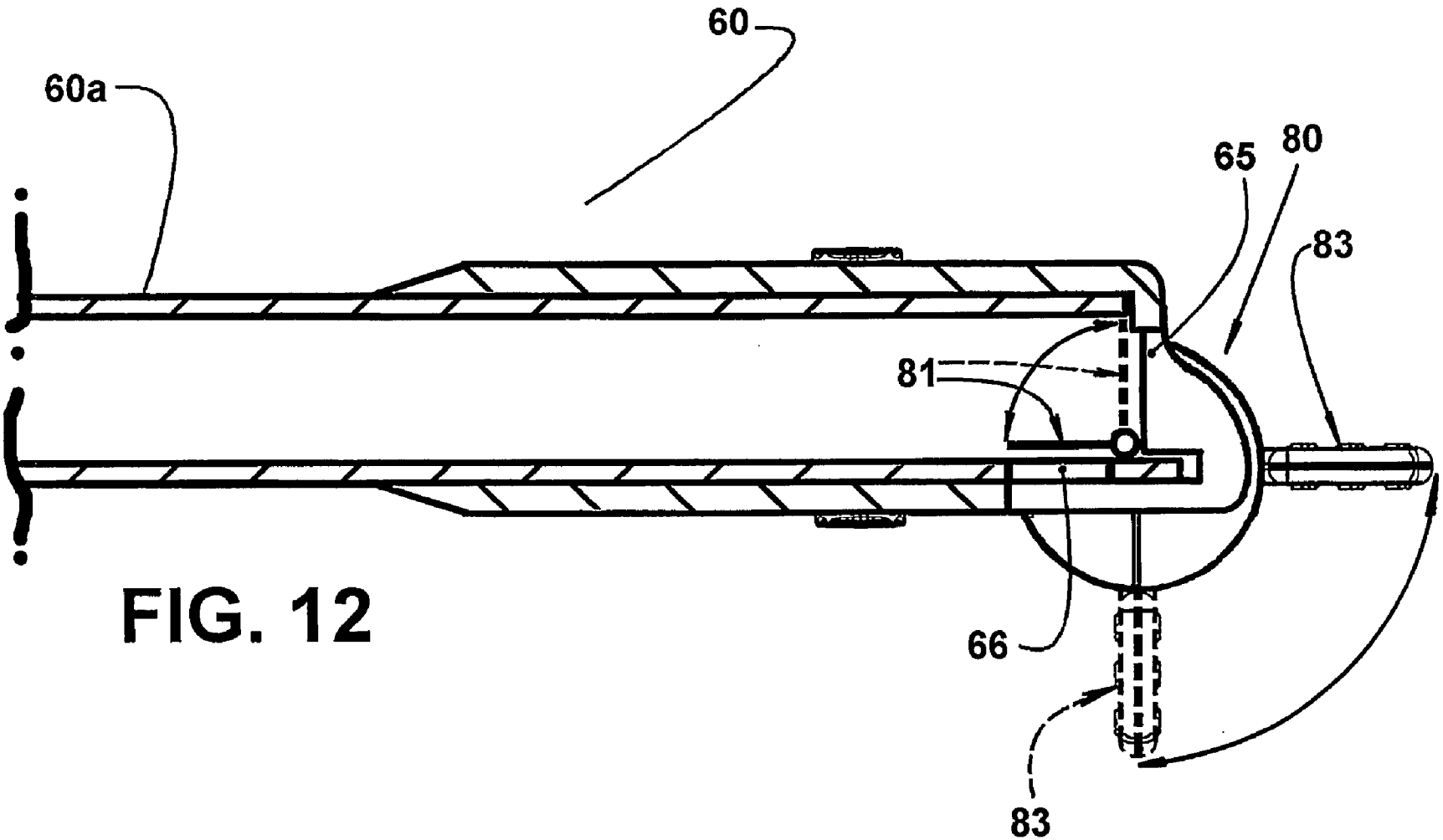
FIG. 12 is a partial cross-sectional view of the distributing duct, taken according to line XII—XII of FIG. 11.
Figure 13:
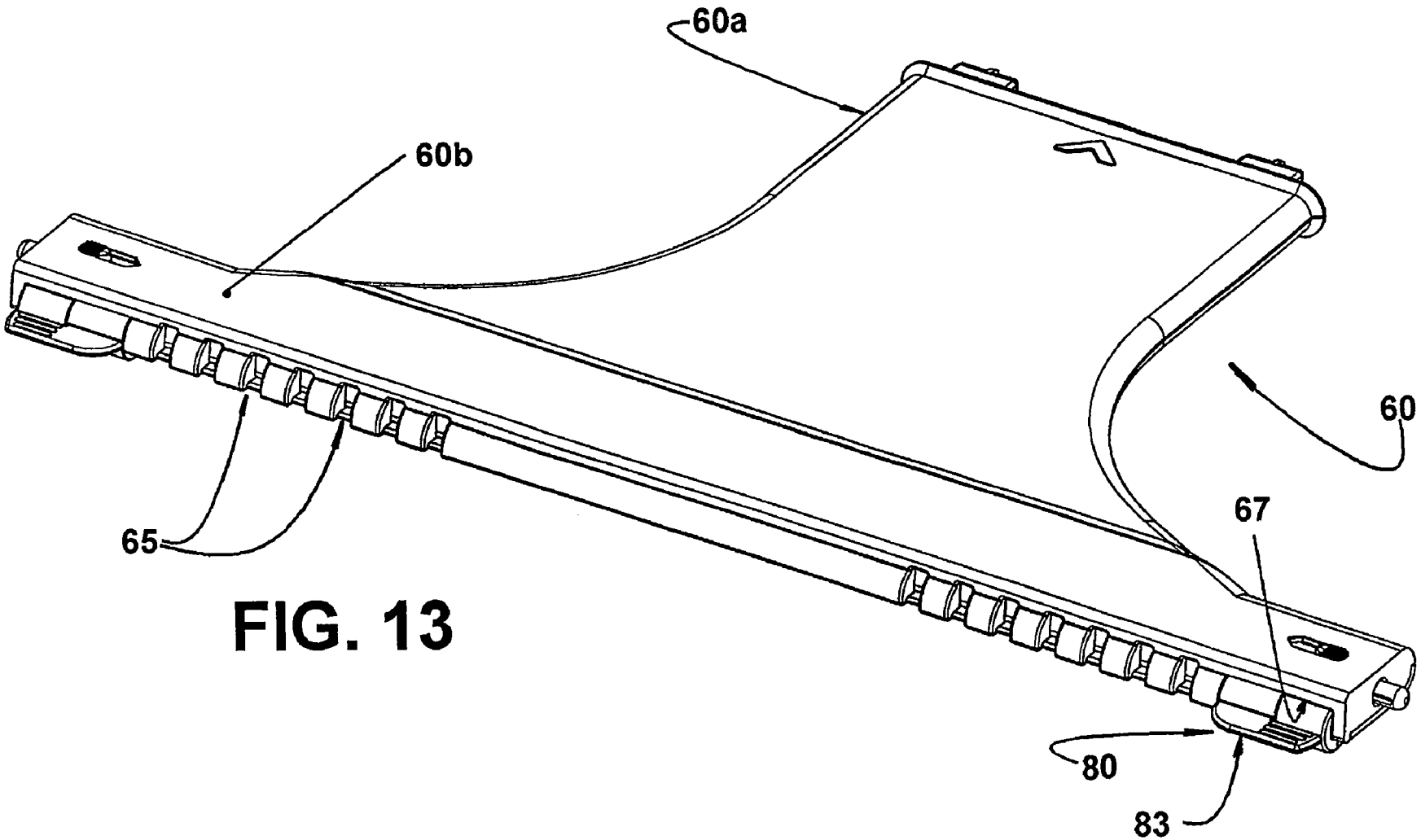
FIG. 13 is a perspective view of a distributing duct presenting front openings that are turned forwardly and front openings that are turned downwardly.
Figure 14:
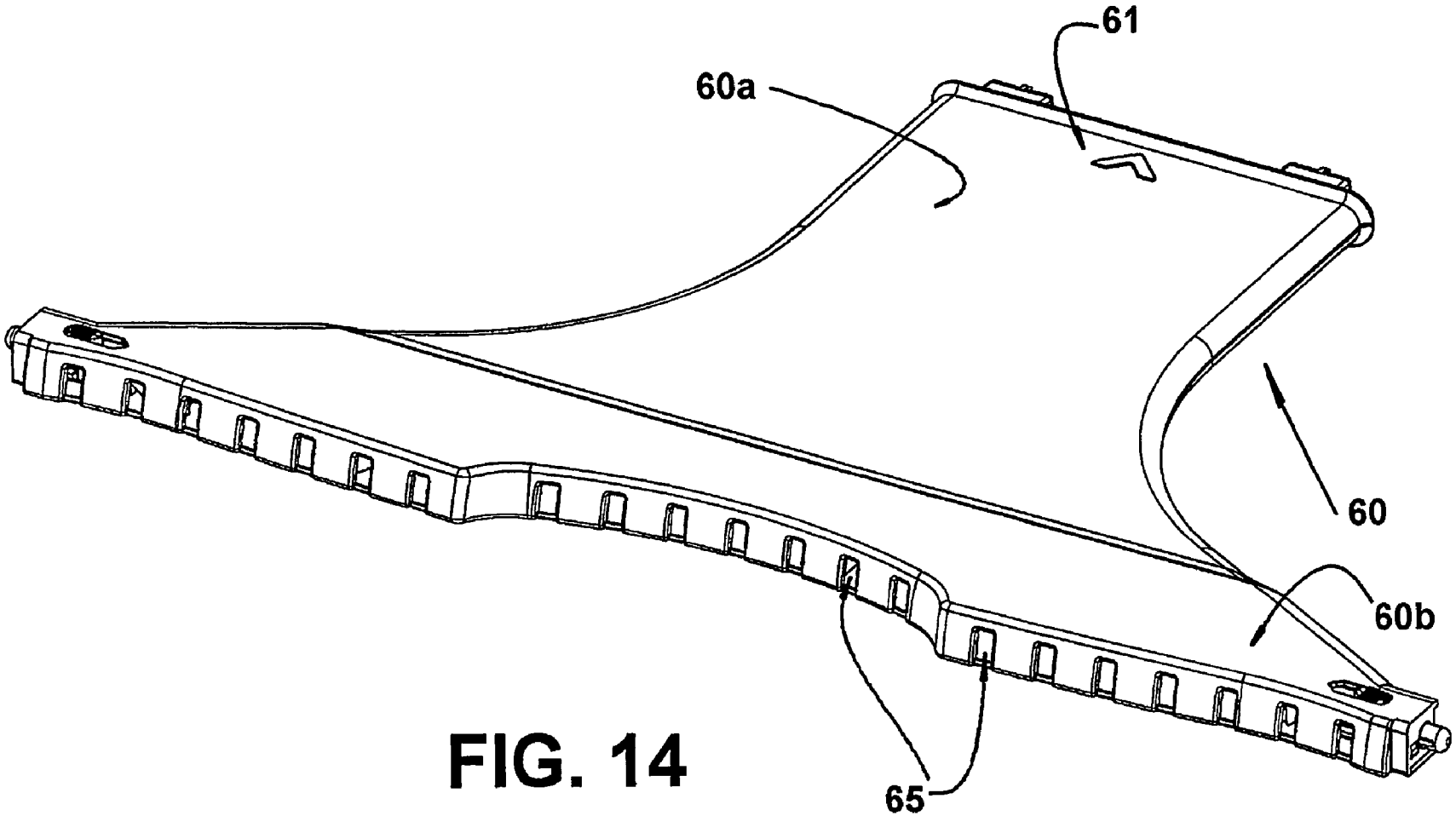
FIG. 14 is a perspective view of a distributing duct presenting only the forwardly turned front openings.

As illustrated in FIG. 7, the air duct arrangement can be further constructed so that both transversal duct extensions 60*b* present front openings 65 disposed along at least part of the length of said transversal duct extensions 60*b* and generally positioned to direct respective refrigerated forced airflows forwardly, toward the door 21 of the refrigerating compartment 20, usually in a somewhat downwardly inclined path.

In this constructive variation, the transversal duct extensions 60*b* may have their outlet ends with no curves, closed and provided with respective front openings 65 to release the airflow toward the respective internal lateral regions of the door.

FIGS. 8–14 are related to another constructive form for the present air duct arrangement. As it can be noted from FIGS. 8–9, it is possible to provide more than one distributing ducts 60, each disposed in a certain level inside the refrigerating compartment. In this constructive form, a second distributing duct 60 is provided below the lower shelf 22, which in the illustrated example is the one defining the cover of a drawer for vegetables or fruits located on the bottom of the refrigerating compartment 20. It should be understood that an identical arrangement may be applied to other upper drawer-shelf assemblies.

In this second embodiment, the distributing duct 60 presents the longitudinal duct extension 60*a* widened in its front region, so as to have its lateral edges matching, by respective concave arcs, the adjacent rear edges of the respective transversal duct extensions 60*b*. The longitudinal duct extension 60*a* is preferably not provided with the radial openings 63 existing in the first embodiment, and the transversal duct extensions 60*b* are provided with forwardly turned front openings 65 and generally with downwardly turned front openings 66. In the case the distributing duct 60 is disposed below the lower shelf 22, the downwardly turned front openings 66 are suppressed and the forwardly turned front openings 65 remain opened to the inside of the compartment.

In the second embodiment described herein, each transversal duct extension 60*b* carries a flow control device 80 to be operated by the user, so as to allow him to adjust the refrigerated forced airflow to be released through the front openings 65 and 66, in order to send said airflow forwardly toward the door 21, or downwardly or also forwardly and downwardly at the same time.

The flow control device 80 can be formed by a deflector 81 made in a single piece in the form of a semi-tubular sleeve (or tubular sleeve), or as a porthole mounted internally to each transversal duct extension 60*b* so that it may be manually and selectively rotated around its longitudinal axis, closing an alignment of front openings 65 and opening the other alignment of front openings 66 that is arranged offset about 90° in relation to the first alignment, or also maintaining both alignments of front openings 65, 66 opened, so as to allow the refrigerated air to flow forwardly and downwardly at the same time.

Each deflector 81, when in the shape of a tubular sleeve, can be further provided with an alignment of windows 82 that are arranged to coincide simultaneously or alternately with both the alignments of front openings 65, 66 of each transversal duct extension 60*b*, or to occupy a position that is completely offset in relation to both alignments of front openings 65, 66.

The movement of the deflector 81 may be effected by a handle 83 projecting outwardly from the distributing duct 60 through a slot 67 provided in the latter. The angular displacement of the handle 83 along the slot 67 allows rotating the deflector 81 to the desired operational position.

It should be understood that the deflector 81 can be constructed in different manners, such as for example in two plates sliding inside each respective transversal duct extension 60*b*, each plate containing an alignment of windows and a handle projecting outwardly from the distributing duct 60, in order to operate in association with a respective alignment of front openings 65, 66.

The distributing duct 60 illustrated in FIGS. 8–13 and provided with forwardly and downwardly turned front openings 65 and 66 can further incorporate internal walls 68 occupying at least part of the internal height of the distributing duct 60 and extending from the region of the rear end 61 to the region of the front end 62 of the distributing duct 60, so as to direct the refrigerated forced airflows received from the openings 23*a* of the diffusing duct 23 to the transversal duct extensions 60*b*, following the curved path of the lateral transition zones between the longitudinal duct extension 60*a* and the transversal duct extensions 60*b*, and facilitating the flow of the refrigerated forced air toward the front openings 65, 66.

As it can be noted from the enclosed figures, the distributing duct 60 is constructed with a reduced height, in order to occupy a minimum vertical space in the space V in which it is mounted, avoiding to impair the food storing capacity of the lower shelf 22 of said space, or of the drawer provided immediately below the distributing duct 60.

The construction proposed by the present invention allows achieving a better distribution of the refrigerated air in the interior of selected regions of the refrigerating compartment, propitiating better and safer conditions of food preservation.

Besides the aspect described above, the construction makes the temperatures in the region of the door approximate the temperatures measured inside the refrigerating compartment, providing a better preservation of the food stored therein.

The construction further presents the advantage of increasing the capacity for refrigerating the beverages stored in the door of the refrigerator, since the user can increase the amount of refrigerated air to be directed to this region.

While the invention has been described and illustrated in relation to a preferred embodiment, it should be understood that changes can be made in the form or physical disposition of the elements, without departing from the constructive concept defined in the claims accompanying the present specification.

The invention claimed is:

1. An air duct arrangement for a refrigerator with forced air circulation comprises a refrigerating compartment closed by a front door and lodging a plurality of shelves and a diffusing duct, which is generally central and mounted close to a rear wall of the refrigerating compartment, in order to receive a refrigerated forced airflow from an air cooling compartment, comprising:

at least one distributing duct disposed in the upper portion of the space defined below at least one of the shelves, said distributing duct having:

a rear end opened to the inside of the diffusing duct;

a front end disposed in the front region of said space adjacent to the front door and provided with a plurality of front openings turned to the front region of said space in whose upper portion is positioned the distributing duct; and a longitudinal duct extension disposed along the central upper portion of the respective space, from the diffusing duct and incorporating, frontally, two transversal duct extensions in which are provided the front openings.

2. The arrangement according to claim 1, wherein the distributing duct is affixed below a shelf that superiorly limits the space inside which is provided the distributing duct.

3. The arrangement according to claim 1, wherein the transversal duct extensions are provided with front openings that are turned forwardly, in order to direct respective refrigerated forced airflows toward the door of the refrigerating compartment.

4. The arrangement according to claim 3, wherein the front openings are disposed along at least part of the length of the transversal duct extensions.

5. The arrangement according to claim 3, wherein the longitudinal duct extension is provided with a plurality of radial openings disposed along at least part of the length of said longitudinal duct extension.

6. The arrangement according to claim 5, wherein the transversal duct extensions have outlet ends that are curved forwardly, each defining a forwardly turned front opening.

7. The arrangement according to claim 6 wherein the distributing duct is provided with a flow control device to be operated by the user, in order to adjust the refrigerated forced airflow released from the front openings and from the radial openings.

8. The arrangement according to claim 7, wherein the flow control device comprises a tubular-sleeve provided with radial windows and which is tightly and slidingly mounted to the inside of the distributing duct, so that it can be displaced between a position in which it aligns the radial windows with the radial openings and blocks the forced airflow to the transversal duct extensions, and a position in which its lateral wall blocks the radial openings and releases the refrigerated forced airflow to the front openings.

9. The arrangement according to claim 8, wherein the displacement of the tubular sleeve is effected by moving a button mounted in the front region of the distributing duct.

10. The arrangement according to claim 9, wherein the tubular sleeve is axially displaced between its limit operational positions, inside the longitudinal duct extension, in one of said positions a front portion of its lateral wall blocking the refrigerated forced airflow to the transversal duct extensions.

11. The arrangement according to claim 9, wherein the tubular sleeve is rotatively displaced between its limit operational positions for control of the refrigerated forced airflow to the radial openings and to the transversal duct extensions.

12. The arrangement according to claim 4, wherein each transversal duct extension is provided with forwardly turned front openings and with downwardly turned openings.

13. The arrangement according to claim 12, wherein each transversal duct extension is provided with a flow control device to be operated by the user, so as to adjust the refrigerated forced airflow to be released from the forwardly turned front openings and from the downwardly turned front openings.

14. The arrangement according to claim 13, wherein each flow control device comprises a deflector mounted to the inside of the respective transversal duct extension, so as to be selectively displaced between operational positions in which it promotes one of the conditions of closing the forwardly turned front openings and opening the downwardly turned front openings and vice-versa, and a condition of simultaneously opening said forwardly and downwardly turned front openings.

15. The arrangement according to claim 14, wherein the deflector incorporates a handle projecting outwardly from the distributing duct through a slot, in order to he displaced by the user to produce the displacement of the deflector to its operational positions.

16. The arrangement according to claim 15, wherein the handle and the deflector can be angularly displaced.

17. The arrangement according to claim 15, wherein the handle and the deflector are linearly displaced to produce an alteration in the refrigerated forced airflow condition through at least one alignment of forwardly turned front openings and of downwardly turned front opening.

18. The arrangement according to claim 12, wherein the distributing duct is provided with internal walls occupying at least part of its internal height and extending from the region of the rear end to the region of the front end of the distributing duct, in order to direct the refrigerated forced airflows received from openings of the diffusing duct to the transversal duct extensions.

19. The arrangement according to claim 18, wherein the lateral transition zones between the longitudinal duct extension and the transversal duct extensions present a concave curved contour, at least part of the internal walls following the contour of said lateral transition zones.

20. The arrangement according to claim 4, wherein that the transversal duct extensions have outlet ends that are curved forwardly, each defining a forwardly turned front opening.

* * * * *